United States Patent [19]

Kubo et al.

[11] Patent Number: 4,609,928

[45] Date of Patent: Sep. 2, 1986

[54] THERMOSENSITIVE IMAGE TRANSFER MEDIUM

[75] Inventors: Keishi Kubo, Yokohama; Nobuhiro Takigawa; Eiichi Kawamura, both of Numazu, all of Japan

[73] Assignee: Ricoh Company, Ltd., Tokyo, Japan

[21] Appl. No.: 561,011

[22] Filed: Dec. 13, 1983

[30] Foreign Application Priority Data

Dec. 16, 1982 [JP] Japan ..... 57-220843

[51] Int. Cl.[4] ..... B41M 5/22

[52] U.S. Cl. ..... 346/208; 346/207; 346/209; 346/216; 346/217; 346/225; 427/150; 427/151

[58] Field of Search ..... 346/207–209, 346/214, 216, 217, 225, 218, 221, 223, 226; 427/150, 151, 152

[56] References Cited

U.S. PATENT DOCUMENTS 4,467,339 8/1984 Asami et al. ..... 346/214

FOREIGN PATENT DOCUMENTS 0142392 9/1982 Japan ..... 346/209

*Primary Examiner*—Bruce H. Hess

*Attorney, Agent, or Firm*—Flynn, Thiel, Boutell & Tanis

[57] ABSTRACT

A thermosensitive image transfer medium consisting of (i) an image transfer sheet having an image transfer layer consisting essentially of a leuco dye, and (ii) an acceptor sheet having an acceptor layer consisting essentially of a color developer which induces color formation in the leuco dye, the color developer being a mixture of a bisphenol derivative of the following formula and a p-hydroxybenzoic acid ester with a melting point of 100° C. or less, and, of the image transfer layer and said acceptor layer, at least one layer containing a porous filler having an oil absorption of 50 ml/100 g or more as measured in accordance with the Japanese Industrial Standard K 5101,

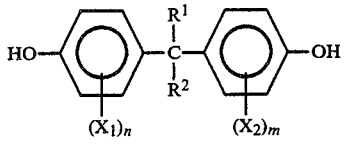

wherein $X^1$ and $X^2$ each represent a lower alkyl group or halogen, $R^1$ and $R^2$ each represent hydrogen or an alkyl group having 1 to 6 carbon atoms, and m and n each represent an integer of 0 through 4.

17 Claims, No Drawings

THERMOSENSITIVE IMAGE TRANSFER MEDIUM

BACKGROUND OF THE INVENTION

The present invention relates to a thermosensitive image transfer medium which is capable of yielding images with high image density by a small amount of thermal energy consumption, and uniform image density even if image transfer is done multiple times from the same thermosensitive image transfer medium, and the thus obtained images are improved on the light resistance and heat resistance.

Conventionally, there are known several thermosensitive image transfer mediums. For example, a thermosensitive image transfer medium consisting of (i) an image transfer sheet comprising a thermal-sublimation-type dye layer formed on a support material and (ii) an acceptor sheet capable of accepting the sublimated dye images from the thermal-sublimation-type dye layer of the image transfer sheet when thermal printing is performed from the back side of the image transfer sheet.

Another conventional thermosensitive image transfer medium consists of (i) an image transfer sheet comprising an image transfer layer formed on a support material, which image transfer layer comprises a thermo-fusible material and a pigment or a dye, and (ii) an acceptor sheet.

The former thermosensitive image transfer material has the shortcomings that the dye images on the acceptor sheet are poor in preservability because of the use of the thermal-sublimation-type dye and, therefore, an overcoating must be provided on the transferred images.

In the latter thermosensitive image transfer medium, the image transfer layer contains a pigment or a dye dispersed in the thermo-fusible material. In this thermosensitive image transfer medium, if a large quantity of the pigment is contained in the image transfer layer in an attempt of obtaining images with high density, the image transfer efficiency decreases, and the result is that it becomes difficult to obtain images with high density, and if a large quantity of the thermo-fusible material is contained in the image transfer layer in order to increase the thermosensitivity, a large quantity of the thermo-fusible material is transferred from the transfer sheet to the acceptor sheet in the course of image transfer and, as a result, it becomes difficult to smoothly peel the transfer sheet off the acceptor sheet and line images on the acceptor sheet become unclear.

In addition to the above-described conventional thermosensitive image transfer mediums, a further thermal printing type thermosensitive image transfer medium is known, in which materials which react with each other to form a color upon application of heat thereto are supported separately in the form of two layers, each layer on a different support material, and thermal printing is performed by bringing the two layers into close contact with each other. In thermosensitive image transfer mediums of this type, the coloring reaction does not occur sufficiently if the image transfer layer is merely transferred to the acceptor layer by bringing them into contact with each other, thus yielding images with low image density. If thermal printing were performed at high temperatures, with application of heat for a long period of time for allowing the coloring reaction to take place sufficiently, images with high density would be obtained on the acceptor sheet. However, the coloring reaction would also take place on the image transfer sheet at the same time. In other words, image formation occurs on both the acceptor sheet and the image transfer sheet.

The inventors of the present application have proposed in Japanese Laid-open Patent Application Ser. No. 57-139347 a thermosensitive image transfer medium, whose acceptor sheet has an acceptor layer containing a porous filler with relatively great oil absorption capability, thereby making improvement on the above described conventional shortcomings.

By this thermosensitive image transfer medium, images with comparatively high image density can be obtained even if it is used a number of times for multiple image transfer. However, the light resistance, the heat resistance and the image density of the images were not satisfactory.

SUMMARY OF THE INVENTION

It is therefore an object of the present invention to provide a thermosensitive image transfer medium with higher thermosensitivity capable of yielding images with higher image density and with higher light resistance and heat resistance, in comparison with the above-described conventional thermosensitive image transfer mediums, which thermosensitive image transfer medium according to the present invention can constantly provide images with uniform image density even if it is used for multiple image transfers, with a small amount of a leuco dye component being transferred from the image transfer layer to the acceptor layer of the recording medium in each image transfer step.

This object of the present invention can be attained by a thermosensitive image transfer medium consisting of (i) an image transfer sheet having an image transfer layer consisting essentially of a leuco dye, and (ii) an acceptor sheet having an acceptor layer consisting essentially of a color developer which induces color formation in the leuco dye, the color developer being a mixture of a bisphenol derivative of the following formula and a p-hydroxybenzoic acid ester with a melting point of 100° C. or less, and the image acceptor layer containing a porous filler having an oil absorption of 50 ml/100 g or more as measured in accordance with the Japanese Industrial Standard K 5101:

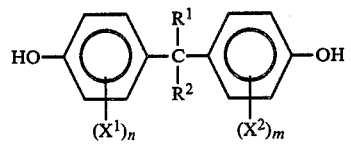

wherein $X^1$ and $X^2$ each represent a lower alkyl group or halogen, $R^1$ and $R^2$ each represent hydrogen or an alkyl group having 1 to 16 carbon atoms, and m and n each represent an integer of 0 through 4.

In the above formula, the lower alkyl group represented by $X^1$ or $X^2$ can be, for instance, a methyl group, an ethyl group, a propyl group or a butyl group, and the halogen represented by $X^1$ or $X^2$ can be, for instance, chlorine, bromine, iodine or fluorine. Further, the alkyl group having 1 to 16 carbon atoms represented by $R^1$ or $R^2$ can be of a chain-type or a branch-type.

DETAILED DESCRIPTION OF THE PREFERRED EMBODIMENTS

In the thermosensitive image transfer medium according to the present invention, the image transfer sheet having the image transfer layer is superimposed on the acceptor sheet having the acceptor layer in such a manner that the acceptor layer comes into close contact with the image transfer layer, and thermal printing is performed from the back side of the image transfer sheet or from the back side of the acceptor sheet, whereby the desired colored images are formed on the acceptor sheet.

In the present invention, a color developer comprising a bisphenol derivative of the above described formula and a p-hydroxybenzoic acid ester with a melting point of 100° C. or less, and a porous filler with an oil adsorption of 50 ml/100 g or more are contained in the acceptor layer of the acceptor sheet, whereby images with high density can be obtained by a small amount of thermal energy consumption and the images are significantly improved with respect to the light resistance and heat resistance in comparison with the transferred images obtained by conventional thermosensitive image transfer mediums.

When the bisphenol derivative is employed alone in the acceptor layer, the color developing speed decreases, the thermosensitivity of the image transfer medium is insufficient for practical use, and it is difficult to obtain images with high density by a small amount of thermal energy consumption.

On the other hand, when the p-hydroxybenzoic acid ester is employed alone in the acceptor layer, the light resistance and heat resistance of the transferred image are insufficient for practical use, and the transferred images deteriorate quickly.

The porous filler, when used in combination with the bisphenol derivative and the p-hydroxybenzoic acid ester, serves to facilitate smooth transfer of a small amount of the leuco dye from the image transfer layer to the acceptor layer at each thermal image transfer step. Thus, multiple copies which bear images with high image density can be obtained from one image transfer sheet just by replacing the acceptor sheet successively with a new acceptor sheet.

Specific examples of the bisphenol derivatives represented by the previously described formula are as follows:

1,1-bis(4'-hydroxyphenyl)methane,
1,1-bis(4'-hydroxyphenyl)ethane,
1,1-bis(4'-hydroxyphenyl)propane,
1,1-bis(4'-hydroxyphenyl)hexane,
1,1-bis(4'-hydroxyphenyl)heptane,
1,1-bis(4'-hydroxyphenyl)-2-propylpentane,
1,1-bis(4'-hydroxyphenyl)-2-ethylhexane,
2,2-bis(4'-hydroxyphenyl)propane,
2,2-bis(4'-hydroxyphenyl)hexane,
2,2-bis(4'-hydroxyphenyl)heptane,
3,3-bis(4'-hydroxyphenyl)hexane,
1,1-bis(3'-methyl-4'-hydroxyphenyl)ethane,
1,1-bis(3'-methyl-4'-hydroxyphenyl)propane,
1,1-bis(3'-methyl-4'-hydroxyphenyl)butane,
1,1-bis(3'-methyl-4'-hydroxyphenyl)pentane,
1,1-bis(3'-methyl-4'-hydroxyphenyl)hexane,
1,1-bis(3'-methyl-4'-hydroxyphenyl)heptane,
2-(3'-methyl-4'-hydroxyphenyl)-2-(4'-hydroxyphenyl)propane,
2,2-bis(3'-methyl-4'-hydroxyphenyl)pentane,
2,2-bis(5'-methyl-4'-hydroxyphenyl)hexane,
2,2-bis(3'-methyl-4'-hydroxyphenyl)4-methylpentane,
1,1-bis(3'-methyl-4'-hydroxyphenyl)4-methylbutane,
3,3-bis(3'-methyl-4'-hydroxyphenyl)pentane,
3,3-bis(3'-methyl-4'-hydroxyphenyl)hexane,
5,5-bis(3'-methyl-4'-hydroxyphenyl)nonane,
2-(4'-hydroxyphenyl)-2-(3'-chloro-4'-hydroxyphenyl)propane,
2,2-bis(3'-isopropyl-4'-hydroxyphenyl)propane,
2,2-bis(3'-tert-butyl-4'-hydroxyphenyl)propane,
2,2-bis(3'-chloro-4'-hydroxyphenyl)propane,
2-(4'-hydroxy-3',5'-dimethylphenyl)-2-(4'-hydroxyphenyl)propane,
bis(3'-methyl-5'-ethyl-4'-hydroxyphenyl)methane, and
1,1-(3'-methyl-5'-butyl-4'-hydroxyphenyl)butane.

Specific examples of the p-hydroxybenzoic acid esters with a melting point of 100° C. or less for use in the present invention are as follows:

p-hydroxybenzoic acid n-propyl ester, (m.p. 98° C.)
p-hydroxybenzoic acid iso-propyl ester, (m.p. 86° C.)
p-hydroxybenzoic acid n-butyl ester, (m.p. 70° C.)
p-hydroxybenzoic acid iso-butyl ester, (m.p. 73° C.)
p-hydroxybenzoic acid n-pentyl ester, (m.p. 54° C.)
p-hydroxybenzoic acid iso-pentyl ester, (m.p. 50° C.)
p-hydroxybenzoic acid n-hexyl ester, (m.p. 52° C.)
p-hydroxybenzoic acid n-heptyl ester, (m.p. 49° C.)
p-hydroxybenzoic acid n-octyl ester, (m.p. 51° C.)
p-hydroxybenzoic acid n-nonyl ester (m.p. 41° C.)

In the present invention, it is preferable that the amount of the p-hydroxybenzoic acid ester contained in the acceptor layer be in the range of 0.3 parts by weight to 4.0 parts by weight with respect to 1 part by weight of the bisphenol derivative. When the amount of the p-hydroxybenzoic acid ester is much smaller than the above range, the color developing speed decreases and therefore the thermosensitivity decreases, although the transferred images are stable. When the amount of the p-hydroxybenzoic acid ester is much greater than the above range, the light resistance and thermal resistance of the transferred images decrease, although the thermosensitivity of the recording medium increases.

The porous filler for use in the present invention has an oil absorption of at least 50 ml/100 g, preferably more than 150 ml/100 g, (which is measured in accordance with the Japanese Industrial Standard K 5101 method). When the oil absorption is less than 50 m/100 g, the object of the present invention cannot be fully attained. The amount of the porous filler contained in the acceptor layer is in the range of 0.05 parts by weight to 10 parts by weight, preferably in the range of 0.1 part by weight to 3 parts by weight with respect to 1 part by weight of the color developer in order to obtain a thermosensitivity sufficient for practical use and transferred images with uniform image density.

Specific examples of the porous filler for use in the present invention are organic or inorganic powder of silica, aluminium silicate, alumina, aluminium hydroxide, magnesium hydroxide, urea-formaldehyde resin and styrene resin.

The image transfer sheet for use in the present invention comprises (i) a support material made of, for example, paper, synthetic paper, plastic film, and (ii) the image transfer layer consisting essentially of the leuco dye formed on the support material. The image transfer layer further contains the above-mentioned porous filler as an auxiliary component.

As the leuco dye for use in the image transfer layer, leuco dyes for use in conventional pressure-sensitive paper and heat-sensitive paper, for example, triphenylmethanetype, fluoran-type, phenothiazine-type, auramine-type and spiropyran-type leuco dyes, can be employed.

Specific examples of these leuco dyes are as follows:

3,3-bis(p-dimethylaminophenyl)phthalide,
3,3-bis(p-dimethylaminophenyl)-6-dimethylaminophthalide (or Crystal Violet Lactone),
3,3-bis(p-dimethylaminophenyl)-6-diethylaminophthalide,
3,3-bis(p-dimethylaminophenyl)-6-chlorophthalide,
3,3-bis(p-dibutylaminophenyl)phthalide,
3-cyclohexylamino-6-chlorofluoran,
3-(N,N-diethylamino)-5-methyl-7-(N,N-dibenzylamino) fluoran,
3-dimethylamino-5,7-dimethylfluoran,
3-diethylamino-7-methylfluoran,
3-diethylamino-7,8-benzfluoran,
3-diethylamino-6-methyl-7-chlorofluoran,
3-pyrrolidino-6-methyl-7-anilinofluoran,
2-{N-(3'-trifluoromethylphenyl)amino}-6-diethylaminofluoran,
2-{3,6-bis(diethylamino)-9-(o-chloroanilino) xanthylbenzoic acid lactam},
3-diethylamino-7-(o-chloroanilino)fluoran,
3-dibutylamino-7-(o-chloroanilino)fluoran,
3-N-methyl-N-amylamino-6-methyl-7-anilinofluoran,
3-N-methyl-N-cyclohexylamino-6-methyl-7-anilinofluoran,
3-(2-hydroxy-4'-dimethylaminophenyl)-3-(2'-methoxy-5'- chlorophenyl)phthalide,
3-(2'-hydroxy-4'-dimethylaminophenyl)-3-(2'-methoxy-5'- nitrophenyl)phthalide,
3-(2'-hydroxy-4'-diethylaminophenyl)-3-(2'-methoxy-5'-methylphenyl)phthalide, and
3-(2'-methoxy-4'-dimethylaminophenyl)-3-(2'-hydroxy-4'- chloro-5'-methylphenyl)phthalide.

In the present invention, the leuco dye is usually used in an amount ranging from 0.3 g to 30 g, preferably in the range of about 0.5 g to about 20 g, with respect to 1 $m^2$ of the support material.

The acceptor sheet for use in the present invention consists of a support material made of, for example, paper, synthetic paper or plastic film, and the acceptor layer formed on the support material, containing a color developer which induces color formation in the leuco dye. As the color developer, the previously described combination of at least the bisphenol derivative and the p-hydroxybenzoic acid ester is employed.

In the present invention, the porous filler with the oil absorption of 50 ml/100 g or more can also be contained in the image transfer layer in order to obtain transferred images with a uniform image density when making multiple copies from one image transfer sheet. When the porous filler is contained in the image transfer layer, it is preferable that the amount of the filler be in range of 0.01 part by weight to 1.0 part by weight, more preferably in the range 0.03 parts by weight to 0.5 parts by weight with respect to 1 part by weight of the leuco dye.

When the image transfer layer and the acceptor layer are formed on each support material, the following conventional binder agents can be employed: water-soluble, organic-solvent-soluble or aqueous-emulsion-forming binder agents such as polyvinyl alcohol, methoxy cellulose, hydroxyethyl cellulose, carboxymethyl cellulose, polyvinylpyrrolidone, polyacrylamide, polyacrylic acid, starch, gelatin, polystyrene, vinyl chloride - vinyl acetate copolymer and polybutyl-methacrylate.

Further in the present invention, a thermo-fusible material with a melting point of not higher than 200° C., preferably not higher than 150° C., can be employed, in the image transfer layer or in the acceptor layer or, if necessary, in both layers. The amount of the thermo-fusible material used is in the range of 0.1 to 50 parts by weight with respect to 1 part by weight of the leuco dye.

Preferable examples of the thermo-fusible materials for use in the present invention are as follows:

(1) Fatty acid amides of the following general formula (I) or (II):

$$R^1NHCOR^2 \quad (I)$$

$$R^3CON\begin{matrix} R^4 \\ R^5 \end{matrix} \quad (II)$$

wherein $R^2$ represents an alkyl group having 1 to 30 carbon atoms, $R^1$ and $R^3$ each represent an alkyl group having 10 to 30 carbon atoms, $R^4$ and $R^5$ each represent hydrogen or a lower alkyl group.

Specific examples of the above fatty acid amides are as follows:

Decylacetamide,
laurylacetamide,
myristylacetamide,
palmitylacetamide,
stearylacetamide,
stearyllaurinamide,
stearylpalmitinamide,
stearylstearinamide,
nonadecylacetamide,
nonadecylpropionamide,
behenylacetamide,
behenylpropionamide, behenylstearinamide,
undecanoic acid methylamide,
undecanoic acid ethylamide,
lauric acid methylamide,
lauric acid ethylamide,
tridecanoic acid methylamide,
tridecanoic acid ethylamide,
myristic acid methylamide,
myristic acid ethylamide,
pentadecanoic acid methylamide,
pentadecanoic acid ethylamide,
palmitic acid methylamide,
palmitic acid dimethylamide,
palmitic acid butylamide,
stearic acid methylamide,
stearic acid ethylamide,
stearic acid propylamide,
stearic acid butylamide,
stearic acid dimethylamide,
stearic acid diethylamide,
stearic acid dibutylamide,
nonadecanoic acid methylamide,
nonadecanoic acid ethylamide,
behenic acid methylamide,
oleic acid methylamide, and
oleic acid ethylamide.

(2) Aromatic carboxylic acid amides represented by the following general formula (III):

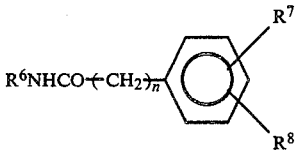

(III)

wherein $R^6$ represents an alkyl group having 1 to 30 carbon atoms, $R^7$ and $R^8$ each represent hydrogen, halogen, a lower alkyl group or a lower alkoxy group, and n is an integer of 0 or 1.

Specific examples of the compounds of the above formula are as follows:

N-stearylbenzamide,
N-palmityl-2-chlorobenzamide,
N-stearyl-2-methoxybenzamide,
N-stearyl-4-methylbenzamide,
N-palmityl-2,4-dimethylbenzamide,
N-behenylbenzamide,
N-behenyl-2-methylbenzamide,
N-stearylphenylacetylamide, and
N-behenylphenylacetylamide.

(3) Amides having cyclohexyl rings represented by the following general formula (IV) or by the following general formula (V)

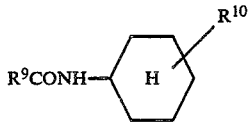

(IV)

wherein $R^9$ represents an alkyl group having 1 to 30 carbon atoms or an unsubstituted or substituted aryl group, and $R^{10}$ represents hydrogen, halogen or a lower alkyl group.

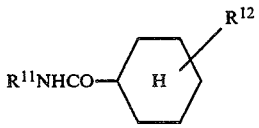

(V)

wherein $R^{11}$ represents an alkyl group having 1 to 30 carbon atoms, and $R^{12}$ represents hydrogen, halogen or a lower alkyl group. p Specific examples of the above compounds are as follows:

N-cyclohexylacetamide,
N-cyclohexylpropionamide,
N-cyclohexylstearic acid amide,
N-cyclohexylbenzamide,
N-cyclohexyl-2-methylbenzamide,
N-cyclohexyl-2-chlorobenzamide,
N-cyclohexyl-2,4-dimethylbenzamide,
N-cyclohexylpalmitic acid amide,
N-(2-chlorohexyl) palmitic acid amide,
N-(2-methylcyclohexyl) stearic acid amide, and
N-stearylhexahydrobenzamide.

(4) Hydroxybenzoic acid phenyl esters represented by the following general formula (VI):

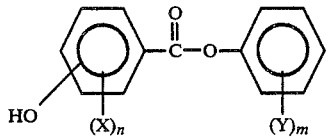

(VI)

wherein X represents halogen, an alkyl group or alkoxy group having 1 to 30 carbon atoms, an unsubstituted or substituted aryl or aralkyl group, an unsubstituted or substituted aryloxy or aralkyloxy group, a carboxyl group or a hydroxyl group, n is an integer of 0, 1, 2 or 3, and m is an integer of 1, 2 or 3.

Specific examples of the above compounds are as follows:

4-hydroxybenzoic acid phenyl ester,
4-hydroxybenzoic acid (2-methoxyphenyl) ester,
4-hydroxybenzoic acid (2-methoxy-4-methylphenyl) ester,
4-hydroxybenzoic acid (3,5-dioxyphenyl) ester,
3-hydroxybenzoic acid (4-carboxyphenyl) ester,
4-hydroxybenzoic acid (4-butoxyphenyl) ester,
4-hydroxybenzoic acid (4-chlorophenyl) ester,
salicylic acid (2-chlorophenyl) ester,
salicylic acid (4-chlorophenyl) ester,
salicylic acid (2,4-dichlorophenyl) ester,
salicylic acid (2,6-dichlorophenyl) ester,
salicylic acid (2,4,6-trichlorophenyl) ester,
salicylic acid (2-bromophenyl) ester,
salicylic acid (4-bromophenyl) ester,
salicylic acid (2,4-dibromophenyl) ester,
salicylic acid (2,6-dibromophenyl) ester,
salicylic acid (2,4,6-tribromophenyl) ester,
salicylic acid (3-methylphenyl) ester,
salicylic acid (2,4-dimethylphenyl) ester,
salicylic acid (4-tert-butylphenyl) ester,
salicylic acid (4-tert-amylphenyl) ester,
salicylic acid (2-methoxyphenyl) ester,
salicylic acid (2-ethoxyphenyl) ester,
salicylic acid (3-methoxyphenyl) ester,
salicylic acid (4-hydroxyphenyl) ester, salicylic acid (4-benzylphenyl) ester,
salicylic acid (4-benzoylphenyl) ester,
salicylic acid (2-methoxy-4-arylphenyl) ester,
salicylic acid (α-naphthyl) ester,
salicylic acid (β-naphthyl) ester,
salicylic acid (4-chloro-3-methylphenyl) ester,
salicylic acid (3-hydroxyphenyl) ester,
salicylic acid (4-propenylphenyl) ester,
5-chlorosalicylic acid (3-methylphenyl) ester,
3,5-dichlorosalicylic acid (2-methoxyphenyl) ester.

(5) Benzoic acid phenyl esters represented by the following general formula:

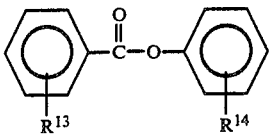

(VII)

wherein $R^{13}$ represents hydrogen, an alkyl group or alkoxy group having 1 to 30 carbon atoms, halogen, a nitro group, nitrile group, an acyloxy group, an unsubstituted or substituted aryl group or aralkyl group, an unsubstituted or substituted aryloxy group or aralkyloxy group, $R^{14}$ represents hydrogen, an alkyl or alkoxy group having 1 to 30 carbon atoms, halogen, a nitro group, a nitrile group, an acyloxy group, an unsubstituted or substituted aryl or aralkyl group, an unsubstituted or substituted aryloxy group or aralkyloxy group or an acyl group.

Specific examples of the above compounds are as follows:

Benzoic acid phenyl ester,
benzoic acid-4-methylphenyl ester,
benzoic acid-2,4-dichlorophenyl ester,
benzoic acid-2,4,6-trichlorophenyl ester,
bezoic acid-2-methyl-4-chlorophenyl ester,
benzoic acid-3-bromophenyl ester,
benzoid acid-2,4-dibromophenyl ester,
benzoid acid-3-iodophenyl ester,
benzoic acid-3-nitrophenyl ester,
benzoic acid-4-methyl-2,6-dichlorophenyl ester,
benzoic acid-4-isopropylphenyl ester,
benzoic acid-4-tert-butylphenyl ester,
benzoic acid-4-benzylphenyl ester,
benzoic acid-4-(1'-naphthyl)phenyl ester,
benzoic acid-2-benzoyloxyphenyl ester,
benzoic acid-4-(2'-methyl)diphenyl ester,
benzoic acid-2-phenylethyloxyphenyl ester,
benzoic acid-2-acetoxyphenyl ester,
benzoic acid-4-methoxyphenyl ester,
benzoic acid-4-(4'-methyl)phenoxyphenyl ester,
4-methylbenzoic acid phenyl ester,
4-methoxybenzoic acid phenyl ester,
4-phenoxybenzoic acid phenyl ester,
4-acetoxybenzoic acid phenyl ester,
4-methoxybenzoic acid-4'-methoxyphenyl ester,
2-acetoxybenzoic acid phenyl ester,
2-benzoyloxybenzoic acid phenyl ester,
2-nitrobenzoic acid-4-methylphenyl ester,
4-nitrobenzoic acid-4-methylphenyl ester,
4-benzoyloxybenzophenone, and
2-benzoyloxy-4'-methylbenzophenone.

(6) Benzoyloxybenzoic acid esters represented by the following formula (VIII):

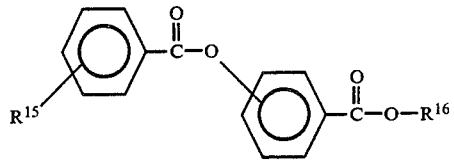

(VII)

wherein $R^{15}$ represents hydrogen, an alkyl group or alkoxy group having 1 to 30 carbon atoms or halogen, $R^{16}$ represents an alkyl group having 1 to 30 carbon atoms or an unsubstituted or substituted aryl or aralkyl group.

Specific examples of the above compounds are as follows:

4-benzoyloxybenzoic acid methyl ester,
4-benzoyloxybenzoic acid ethyl ester,
4-benzoyloxybenzoic acid-n-propyl ester,
4-benzoyloxybenzoic acid benzyl ester,
4-benzoyloxybenzoic acid phenyl ester,
2-benzoyloxybenzoic acid phenyl ester,
4-(4'-methylbenzoyloxy)benzoic acid ethyl ester,
4-(4'-methoxybenzoyloxy)benzoic acid ethyl ester,
4-(4'-chlorobenzoyloxy)benzoic acid ethyl ester.

In the image transfer sheet for use in the present invention, the image transfer layer can be formed uniformly on the entire surface of the support material or imagewise in the necessary portions on the support material. The image transfer layer which is formed uniformly on the entire surface of the support material can be formed by merely applying the image transfer layer formation liquid uniformly to the support material. The image transfer sheet having an image-like image transfer layer can be prepared by applying the image formation liquid to the surface of the support material by anastatic printing or by photogravure. Alternatively the image transfer sheet having an image-like image transfer layer can be prepared by superimposing the transfer sheet having the image transfer layer on the entire surface thereof on an appropriate support material such as paper, synthetic paper, or plastic film and applying pressure imagewise from the back side of the support material or from the back side of the image transfer sheet by use of pressure application means such as a typewriter or a steel pen or by use of heat application means such as a thermal head or thermal pen, whereby the image transfer layer is imagewise transferred from the image transfer sheet to the surface of the support material.

When thermal image transfer is conducted in the present invention, for example, by use of the image transfer sheet having the image-like image transfer layer, an acceptor sheet is superimposed on the surface of the image transfer sheet in such a manner that the acceptor layer comes into contact with the image transfer layer, and the image transfer sheet and the acceptor sheet are caused to pass, for instance, between a pair of heat application rollers. When the image transfer sheet having the image transfer layer on the entire surface thereof is used, the acceptor sheet is superimposed on the image transfer sheet in such a manner that the acceptor layer is in close contact with the image transfer layer of the image transfer sheet, and direct thermal printing is conducted by use of a thermal printer from the back side of the image transfer sheet, or the acceptor sheet is superimposed on the image transfer sheet in the above-mentioned manner and a transparent original sheet having images, for example, written in black ink is further superimposed closely on the back side of the image transfer sheet and infrared rays are projected to the acceptor sheet, so that the black image portions of the original sheet are selectively heated to a high temperature, thus thermal image transfer is conducted corresponding to the images of the original sheet. In this case, it is necessary that the image transfer sheet and the acceptor sheet be transparent to infrared rays.

In the thermosensitive image transfer in the present invention, a number of copies can be easily made by repeating the above described operation, using the same image transfer sheet. When making copies with multiple colors, a plurality of image transfer sheets, each of which contains a leuco dye with a different color from the colors of other leuco dyes, are prepared, for instance, an image transfer sheet containing a leuco dye which can be colored blue and another image transfer sheet containing a leuco dye which can be colored red are prepared. By superimposing those image transfer sheets successively on the same acceptor sheet, blue and red images can be formed on the same acceptor sheet.

In the present invention, the leuco dye and the color developer which induces color formation in the leuco dye are separately supported on different support materials. Therefore, no color fogging occurs during the preparation of the thermosensitive image transfer medium and during the storage thereof, unlike the conventional thermosensitive sheets.

Further, in the copies made by the present invention, no leuco dye is present in the non-image areas of the copy sheets, and only the color developer is present. Therefore, even if the copy sheet happens to be heated, no further coloring takes place. In other words, in the copies obtained by the present invention, image fixing is perfect. In addition to the above-mentioned advantage of the present invention, images with high density can be obtained by use of a small amount of thermal energy consumption, and a number of copies can be made from one image transfer sheet, and images formed on those copies are uniform in image density because a constant amount of the. leuco dye is transferred from the image transfer layer of the image transfer sheet to the acceptor layer of the acceptor sheet during each image transfer step. Further the thus formed images are excellent in light resistance and heat resistance.

Embodiments of a thermosensitive image transfer medium according to the present invention will now be explained by referring to the following examples.

EXAMPLE 1

Preparation of Image Transfer Sheet A-1

An image transfer layer formation liquid was prepared by dissolving the following components.

| | |
|---|---|
| 3-N—methyl-N—cyclohexylamino-6-methyl-7-anilinofluoran | 10 |
| Ethyl cellulose | 2.5 |
| Methyl ethyl ketone | 100 |

The thus prepared image transfer layer formation liquid was applied by a wire bar to a sheet of condenser paper with a thickness of 15 μm, with a deposition of the above solid components thereof in an amount of 6.5 g/m$^2$ when dried, whereby an image transfer sheet A-1 was prepared.

Preparation of Acceptor Sheet B-1

The following components were dispersed in a ball mill for 24 hours to prepare an acceptor layer formation liquid.

| | Parts by Weight |
|---|---|
| 1,1-bis(4'-hydroxyphenyl)-2-ethylhexane | 15 |
| p-hydroxybenzoic acid n-butyl ester | 5 |
| benzoic acid-4-methoxyphenyl ester (thermo-fusible material) | 15 |
| Silica particles (with an oil absorption 200 ml/100 g) | 10 |
| Polyvinyl alcohol | 4 |
| Water | 100 |

The thus prepared acceptor layer formation liquid was applied to a sheet of high quality paper (35 g/m$^2$) by a wire bar, with a deposition of the solid components thereof in an amount of 5.5 g/m$^2$ when dried, whereby an acceptor sheet B-1 was prepared.

The image transfer sheet A-1 was superimposed on the acceptor sheet B-1 in such a manner that the image transfer layer of the image transfer sheet A-1 was in close contact with the acceptor layer of the acceptor sheet B-1, and 1.2 mm Joule of thermal energy was applied through a thermal head to the back side of the image transfer sheet A-1. As a result, clear black images were formed on the acceptor sheet B-1. The reflection image density of the thus formed black images was measured by use of a Macbeth densitometer (RD-514). The result is shown in Table 1.

The light resistance and heat resistance of the above images were also measured under the following respective conditions:

Light Resistance: The black images formed on the acceptor sheet B-1 were exposed to ultraviolet rays by allowing the acceptor sheet B-1 to stand at 60° C. and 80% RH for 3 hours. Thereafter, the reflection image density of the images was measured by the Macbeth densitometer.

Heat Resistance: The black-images-bearing acceptor sheet B-1 was allowed to stand at 60° C. and room humidity for 24 hours and the reflection image density of the black images was then measured by the Macbeth densitometer.

COMPARATIVE EXAMPLE 1

From the formulation of the acceptor sheet B-1 in Example 1, 1,1-bis(4'-hydroxyphenyl)-2-ethylhexane was eliminated, that is, p-hydroxybenzoic acid n-butyl ester was employed as the color developer, so that a comparative acceptor layer formation liquid 1 was prepared.

By applying the comparative acceptor layer formation liquid 1 to the same condenser paper as that employed in Example 1 with the same amount of the deposition of the solid components thereof as in Example 1, a comparative acceptor sheet CB-1 was prepared.

By use of the comparative acceptor sheet CB-1 and the image transfer sheet A-1 prepared in Example 1, image formation was carried out in the same manner as in Example 1. As a result, black images were formed on the comparative acceptor sheet CB-1. The image density of the black images was measured by the Macbeth densitometer in the same manner as in Example 1. The light resistance and heat resistance of the images were also measure under the same conditions as in Example 1. The results are shown in Table 1.

COMPARATIVE EXAMPLE 2

From the formulation of the acceptor sheet B-1 in Example 1, p-hydroxybenzoic acid n-butyl ester was eliminated, that is, only 1,1-bis(4'-hydroxyphenyl)-2-ethylhexane was employed as the color developer, so that a comparative acceptor layer formation liquid 2 was prepared.

By applying the comparative acceptor layer formation liquid 2 to the same condenser paper as that employed in Example 1 with the same amount of the deposition of the solid components thereof as in Example 1, a comparative acceptor sheet CB-2 was prepared.

By use of the thus prepared comparative acceptor sheet CB-2 and the image transfer sheet A-1 prepared in Example 1, image formation was carried out in the same manner as in Example 1. As a result, black images were formed on the comparative acceptor sheet CB-2. The image density of the black images was measured by the Macbeth densitometer in the same manner as in Example 1. The light resistance and heat resistance of the images were also measured under the same conditions as in Example 1. The results are shown in Table 1.

COMPARATIVE EXAMPLE 3

From the formulation of the acceptor sheet B-1 in Example 1, 1,1-bis(4'-hydroxyphenyl)-2-ethylhexane and the silica particles were eliminated, that is, only p-hydroxybenzoic acid n-butyl ester was employed as the color developer, so that a comparative acceptor layer formation liquid 3 was prepared.

By applying the comparative acceptor layer formation liquid 3 to the same condenser paper as that employed in Example 1 with the same amount of the deposition of the solid components thereof as in Example 1, a comparative acceptor sheet CB-3 was prepared.

By use of the thus prepared comparative acceptor sheet CB-3 and the image transfer sheet A-1 prepared in Example 1, image formation was carried out in the same manner as in Example 1. As a result, black images were formed on the comparative acceptor sheet CB-3. The image density of the black images was measured by the Macbeth densitometer in the same manner as in Example 1. The light resistance and heat resistance of the images were also measured under the same conditions as in Example 1. The light resistance and heat resistance of the images were also measured under the same conditions as in Example 1. The results are shown in Table 1.

TABLE 1

| | Image Transfer Sheet | Acceptor Sheet | Image Density | Light Resistance | Heat Resistance |
|---|---|---|---|---|---|
| Example 1 | A-1 | B-1 | 1.18 | 1.20 | 1.28 |
| Comparative Example 1 | A-1 | CB-1 | 1.30 | 0.52 | 0.57 |
| Comparative Example 2 | A-1 | CB-2 | 1.04 | 1.25 | 1.34 |
| Comparative Example 3 | A-1 | CB-3 | 1.25 | 0.7 | 0.52 |

EXAMPLE 2

Preparation of Acceptor Sheet B-2

The following components were dispersed in a ball mill for 24 hours to prepare an acceptor layer formation liquid.

| | Parts by Weight |
|---|---|
| 1,1-bis(3'-methyl-4'-hydroxyphenyl) heptane | 10 |
| p-hydroxybenzoic acid n-butyl ester | 10 |
| benzoic acid-4-methoxyphenyl ester (thermo-fusible material) | 15 |
| Silica particles (with an oil absorption 200 m/100 g) | 10 |
| Polyvinyl alcohol | 4 |
| Water | 100 |

The thus prepared acceptor layer formation liquid was applied to a sheet of high quality paper (35 g/m$^2$) by a wire bar, with a deposition of the solid components thereof in an amount of 5.5 g/m$^2$ when dried, whereby an acceptor sheet B-2 was prepared.

By use of the thus prepared acceptor sheet B-2 and the image transfer sheet A-1 prepared in Example 1, image formation was carried out in the same manner as in Example 1. As a result, black images were formed on the comparative acceptor sheet B-2. The image density of the black images was measured by the Macbeth densitometer in the same manner as in Example 1. The light resistance and heat resistance of the images were also measured under the same conditions as in Example 1. The same excellent results as in Example 1 were obtained with respect to the image density, the light resistance and the heat resistance.

EXAMPLE 3

Preparation of Acceptor Sheet 2

The following components were dispersed in a ball mill for 24 hours to prepare an acceptor layer formation liquid.

| | Parts by Weight |
|---|---|
| 2,2-bis(3'-chloro-4'-hydroxyphenyl)propane | 5 |
| p-hydroxybenzoic acid n-butyl ester | 15 |
| benzoic acid-4-methoxyphenyl ester (thermo-fusible material) | 15 |
| Silica particles (with an oil absorption 200 m/100 g) | 10 |
| Polyvinyl alcohol | 4 |

-continued

| | Parts by Weight |
|---|---|
| Water | 100 |

The thus prepared acceptor layer formation liquid was applied to a sheet of high quality paper (35 g/m$^2$) by a wire bar, with a deposition of the solid components thereof in an amount of 5.5 g/m$^2$ when dried, whereby an acceptor sheet B-3 was prepared.

By use of the thus prepared acceptor sheet B-3 and the image transfer sheet A-1 prepared in Example 1, image formation was carried out in the same manner as in Example 1. As a result, black images were formed on the comparative acceptor sheet B-3. The image density of the black images was measured by the Macbeth densitometer in the same manner as in Example 1. The light resistance and heat resistance of the images were also measured under the same conditions as in Example 1. The same excellent results as in Example 1 were obtained with respect to the image density, the light resistance and the heat resistance.

EXAMPLE 4

An image transfer layer formation liquid was prepared by replacing 3-N-methyl-N-cyclohexyalamino-6-methyl-7-anilinofluoran with 3-diethylamino-6-chlorofluoran in the formulation of the image transfer sheet A-1 in Example 1. By use of this image tranfser layer formation liquid an image transfer sheet A-2 for formation of red images was prepared in the same manner as in Example 1.

The thus prepared image transfer sheet A-2 was superimposed on the acceptor sheet B-1 with black images already formed thereon by the same procedure as in Example 1, so that the image transfer layer of the image transfer sheet A-2 was brought into close contact with the acceptor layer of the acceptor sheet B-1. As in Example 1, 1.2 mm Joule of thermal energy was applied through a thermal head to the back side of the image transfer sheet A-2. As a result, clear red images were formed on the acceptor sheet B-1. Consequently, the red images and the black images were formed on the acceptor sheet B-1.

The thus obtained red images and black images were subjected to the same light resistance and heat resistance tests as in Example 1. The results of these tests were as excellent as in Example 1.

EXAMPLE 5

From the image transfer sheet A-1 prepared in Example 1, 10 copies were made using 10 new acceptor sheets B-1 successively. The transferred images were almost the same in image density in the first copy through the 10th copy. The images in the 10th copy were subjected to the same light resistance and heat resistance tests as in Example 1. The result was that the light resistance and heat resistance thereof were as excellent as the images in the first copy.

What is claimed is:

1. A thermosensitive image transfer medium comprising (i) an image transfer sheet having an image transfer layer consisting essentially of aleuco dye; and (ii) an acceptor sheet having an acceptor layer consisting essentially of a color developer which induces color formation in said leuco dye, said color developer being a mixture of a bisphenol derivative and a p-hydroxybenzoic acid ester having a melting point of 100° C. or less, said bisphenol derivative having the formula

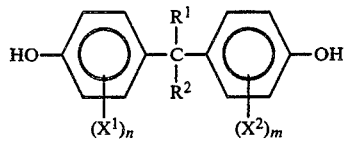

wherein $X^1$ and $X^2$ each represent a loer alkyl group or halogen, $R^1$ and $R^2$ each represent hydrogen or an alkyl group having 1 to 16 carbon atoms, and m and n each represent an integer of 0 through 4; at least one of said image transfer layer and said acceptor layer containing a porous filler having an oil absorption of 50 ml/100 g or more as measured in accordance with the Japanese Industrial Standard K 5101.

2. A thermosensitive image transfer medium as claimed in claim 1, wherein the amount of said p-hydroxybenzoic acid ester is in the range of 0.3 part by weight to 4.0 parts by weight with respect to 1 part by weight of said bisphenol derivative.

3. A thermosensitive image transfer medium as claimed in claim 1, wherein said porous filler is present in said acceptor layer in an amount in the range of 0.05 parts by weight to 10 parts by weight with respect to 1 part of said color developer.

4. A thermosensitive image transfer medium as claimed in claim 1, wherein said porous filler is present in said image transfer layer in an amount in the range of 0.01 part by weight to 1 part by weight with respect to 1 part of said leuco dye.

5. A thermosensitive image transfer medium as claimed in claim 1, wherein the amount of said leuco dye in said image transfer layer is in the range of 0.3 g/m$^2$ to 30 g/m$^2$.

6. A thermosensitive image transfer medium as claimed in claim 1, wherein said leuco dye is selected from the group consisting of triphenylmethane-type leuco dyes, fluoran-type leuco dyes, phenothiazine-type leuco dyes, auramine-type leuco dyes and spiropyran-type leuco dyes.

7. A thermosensitive image transfer medium as claimed in claim 1, wherein at least one of said image transfer layer and said acceptor layer contains a thermo-fusible material with a melting point of not higher than 200° C. in an amount ranging from 0.1 part by weight to 50 parts by weight with respect to 1 part by weight of said leuco dye.

8. A thermosensitive image transfer medium as claimed in claim 7, wherein said thermo-fusible material is selected from the group consisting of the fatty acid amides of the general formula (I) and the fatty acid amides of the general formula (II)

$$R^1HNCOR^2 \quad (I)$$

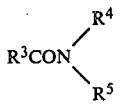

(II)

wherein $R^2$ represents an alkyl group having 1 to 30 carbon atoms, $R^1$ and $R^3$ each represent an alkyl group having 10 to carbon atoms, $R^4$ and $R^5$ each represent hydrogen or a lower alkyl group.

9. A thermosensitive image transfer medium as claimed in claim 7, wherein said thermo-fusible material is selected from the group consisting of the aromatic carboxylic acid amides of the general formula (III)

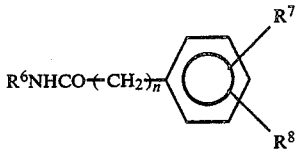

(III)

wherein $R^6$ represents an alkyl group having 1 to 30 carbon atoms, $R^7$ and $R^8$ each represent hydrogen, halogen, a lower alkyl group or a lower alkoxy group, and n is an integer of 0 or 1.

10. A thermosensitive image transfer medium as claimed in claim 7, wherein said thermo-fusible material is selected from the group consisting of the amides having cyclohexyl rings of the general formula (IV) and the amides having cyclohexyl rings of the general formula (V)

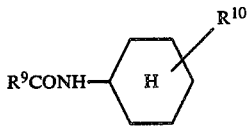

(IV)

wherein $R^9$ represents an alkyl group having 1 to 30 carbon atoms or an unsubstituted or substituted aryl group, and $R^{10}$ represents hydrogen, halogen or a lower alkyl group,

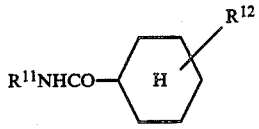

(V)

wherein $R^{11}$ represents an alkyl group having 1 to 30 carbon atoms, and $R^{12}$ represents hydrogen, halogen or a lower alkyl group.

11. A thermosensitive image transfer medium as claimed in claim 7, wherein said thermo-fusible material is selected from the group consisting of the hydroxybenzoic acid phenyl esters of the general formula (VI)

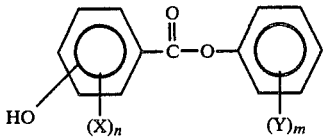

(VI)

wherein X represents halogen, an alkyl group or alkoxy group having 1 to 30 carbon atoms, an unsubstituted or substituted aryl or aralkyl group, an unsubstituted or substituted aryloxy or aralkyloxy group, a carboxyl group or a hydroxyl group, n is an integer of 0, 1, 2 or 3, and m is an integer of 1, 2 or 3.

12. A thermosensitive image transfer medium as claimed in claim 7, wherein said thermo-fusible material is selected from the group consisting of the benzoic acid phenyl esters of the general formula (VII)

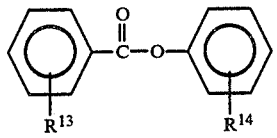

(VII)

wherein $R^{13}$ represents hydrogen, an alkyl group or alkoxy group having 1 to 30 carbon atoms, halogen, a nitro group, nitrile group, an acyloxy group, an unsubstituted or substituted aryl group or aralkyl group, an unsubstituted or substituted aryloxy group or aralkyloxy group, $R^{14}$ represents hydrogen, an alkyl or alkoxy group having 1 to 30 carbon atoms, halogen, a nitro group, a nitrile group, an acyloxy group, an unsubstituted or substituted aryl or aralkyl group, an unsubstituted or substituted aryloxy group or aralkyloxy group or an acyl group.

13. A thermosensitive image transfer medium as claimed in claim 7, wherein said thermo-fusible material is selected from the group consisting of the benzoyloxybenzoic acid esters of the formula (VIII)

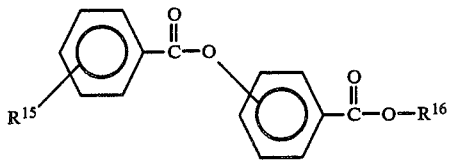

(VIII)

wherein $R^{15}$ represents hydrogen, an alkyl group or alkoxy group having 1 to 30 carbon atoms or halogen, $R^{16}$ represents an alkyl group having 1 to 30 carbon atoms or an unsubstituted or substituted aryl or aralkyl group.

14. A thermosensitive image transfer medium as claimed in claim 1, wherein said bisphenol derivative is selected from the group consisting of:

1,1-bis(4'-hydroxyphenyl)methane,
1,1-bis(4'-hydroxyphenyl)ethane,
1,1-bis(4'-hydroxyphenyl)propane,
1,1-bis(4'-hydroxyphenyl)hexane,
1,1-bis(4'-hydroxyphenyl)heptane,
1,1-bis(4'-hydroxyphenyl)-2-propylpentane,
1,1-bis(4'-hydroxyphenyl)-2-ethylhexane, 2,2-bis(4'-hydroxyphenyl)propane,
2,2-bis(4'-hydroxyphenyl)hexane,
2,2-bis(4'-hydroxyphenyl)heptane,
3,3-bis(4'-hydroxyphenyl)hexane,
1,1-bis(3'-methyl-4'-hydroxyphenyl)ethane,
1,1-bis(3'-methyl-4'-hydroxyphenyl)propane,
1,1-bis(3'-methyl-4'-hydroxyphenyl)butane,
1,1-bis(3'-methyl-4'-hydroxyphenyl)pentane,
1,1-bis(3'-methyl-4'-hydroxyphenyl)hexane,
1,1-bis(3'-methyl-4'-hydroxyphenyl)heptane,
2-(3'-methyl-4'-hydroxyphenyl)-2-(4'-hydroxyphenyl)propane,
2,2-bis(3'-methyl-4'-hydroxyphenyl)pentane,
2,2-bis(5'-methyl-4'-hydroxyphenyl)hexane,
2,2-bis(3'-methyl-4'-hydroxyphenyl)4-methylpentane,
1,1-bis(3'-methyl-4'-hydroxyphenyl)4-methylbutane,
3,3-bis(3'-methyl-4'-hydroxyphenyl)pentane,
3,3-bis(3'-methyl-4'-hydroxyphenyl)hexane,
5,5-bis(3'-methyl-4'-hydroxyphenyl)nonane,
2-(4'-hydroxyphenyl)-2-(3'-chloro-4'-hydroxyphenyl)propane,
2,2-bis(3'-isopropyl-4'-hydroxyphenyl)propane,
2,2-bis(3'-tert-butyl-4'-hydroxyphenyl)propane,
2,2-bis(3'-chloro-4'-hydroxyphenyl)propane,
2-(4'-hydroxy-3',5'-dimethylphenyl)-2-(4'-hydroxyphenyl)propane,
bis(3'-methyl-5'-ethyl-4'-hydroxyphenyl)methane, and
1,1-(3'-methyl-5'-butyl-4'-hydroxyphenyl)butane.

15. A thermosensitive image transfer medium as claimed in claim 1, wherein said p-hydroxybenzoic acid ester is selected from the group consisting of:
p-hydroxybenzoic acid n-propyl ester,
p-hydroxybenzoic acid iso-propyl ester,
p-hydroxybenzoic acid n-butyl ester,
p-hydroxybenzoic acid iso-butyl ester,
p-hydroxybenzoic acid n-pentyl ester,
p-hydroxybenzoic acid iso-pentyl ester,
p-hydroxybenzoic acid n-hexyl ester,
p-hydroxybenzoic acid n-heptyl ester,
p-hydroxybenzoic acid n-octyl ester, and
p-hydroxybenzoic acid n-nonyl ester.

16. A thermosensitive image transfer medium as claimed in claim 1, wherein said filler is selected from the group consisting of silica, aluminum silicate, alumina, aluminum hydroxide, magnesium hydroxide, urea-formaldehyde resin and styrene resin.

17. A thermosensitive image transfer medium, comprising: an image transfer sheet comprising a first support having an image transfer layer thereon; an acceptor sheet separate from said image transfer sheet and comprising a second support having an acceptor layer thereon; said image transfer layer consisting essentially of (a) from 0.3 to 30 grams of leuco dye per square meter of said first support, and (b) first binder agent; said acceptor layer consisting essentially of (c) a color developer which, when said acceptor layer is heated while in contact with said image transfer layer, can react with said leuco dye to color said dye, said color developer being a mixture of a bisphenol derivative and a p-hydroxybenzoic acid ester having a melting point of 100° C. or less, said bisphenol derivative having the formula

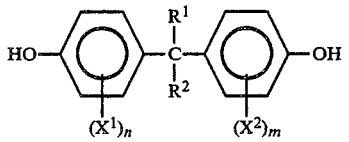

Wherein $X^1$ and $X^2$ each represent a lower alkyl group or halogen, $R^1$ and $R^2$ each represent hydrogen or an alkyl group having 1 to 16 carbon atoms, and m and n each represent an integer of 0 through 4; (d) from 0.05 to 10 parts by weight of porous filler particles per 1 part by weight of said coloring developer, said porous filler particles having an oil absorption of 50 ml/100 g or higher as measured in accordance with Japanese Industrial Standard K 5101, and (e) second binder agent, whereby when an assembly is formed of said acceptor sheet with said image transfer sheet in which said acceptor layer is in face-to-face contact with said image transfer layer and heat is applied in an imagewise pattern on either said first support or said second support, there will occur imagewise transfer of small amounts of said leuco dye from said image transfer layer to said acceptor layer and a color-forming reaction will occur in said acceptor layer to form a corresponding image on said acceptor layer, said acceptor sheet then being separable from said image transfer sheet to provide a copied image and said image transfer sheet being capable of repeated use with other like acceptor sheets.

* * * * *

UNITED STATES PATENT AND TRADEMARK OFFICE

CERTIFICATE OF CORRECTION

PATENT NO. : 4 609 928

DATED : September 2, 1986

INVENTOR(S) : Keishi Kubo et al

It is certified that error appears in the above-identified patent and that said Letters Patent is hereby corrected as shown below:

Column 15, line 68; change "aleuco" to ---a leuco---.

Column 16, line 16; change "loer" to ---lower---.

Column 17, line 10; after "to" insert ---30---.

Signed and Sealed this

Twenty-fourth Day of February, 1987

*Attest:*

DONALD J. QUIGG

*Attesting Officer* *Commissioner of Patents and Trademarks*